US005188023A

United States Patent [19]

Mansfield et al.

[11] Patent Number: 5,188,023

[45] Date of Patent: * Feb. 23, 1993

[54] CAST FORMED BI-METALLIC WORM ASSEMBLY AND METHOD

[75] Inventors: Peter W. Mansfield, Holmes Beach, Fla.; Frank N. Dupps, Germantown, Ohio

[73] Assignee: The Dupps Company, Germantown, Ohio

[ * ] Notice: The portion of the term of this patent subsequent to Mar. 5, 2008 has been disclaimed.

[21] Appl. No.: 784,981

[22] Filed: Oct. 30, 1991

[51] Int. Cl.[5] ..... B30B 3/00; B22D 19/16

[52] U.S. Cl. ..... 100/145; 164/111

[58] Field of Search ..... 164/98, 111; 100/145, 100/117

[56] References Cited

U.S. PATENT DOCUMENTS

| | | | |
|---|---|---|---|
| 929,687 | 8/1909 | Monnot | 164/98 |
| 3,307,423 | 3/1967 | Dansi | 164/111 |
| 3,659,323 | 5/1972 | Hachisu et al. | 164/95 |
| 3,863,701 | 2/1975 | Niimi et al. | 164/100 |
| 4,023,613 | 5/1977 | Uebayasi et al. | 164/111 |
| 4,693,293 | 9/1987 | Yamamoto et al. | 164/98 |
| 4,996,919 | 3/1991 | Mansfield | 100/117 |

FOREIGN PATENT DOCUMENTS

| | | | |
|---|---|---|---|
| 0104262 | 6/1984 | Japan | 164/98 |

*Primary Examiner*—Richard K. Seidel
*Assistant Examiner*—Erik R. Puknys
*Attorney, Agent, or Firm*—Charles J. Prescott

[57] ABSTRACT

A cast-formed bi-metallic worm assembly of a mechanical screw press for expressing liquids from fibrous materials and a method of manufacture therefor and the product produced by the method. The worm assembly is rotatably driven by the press drive shaft and includes an outer flight body having an integral outwardly extending helical flight formed of a relatively brittle, wear-resistant homogeneous cast material and an inner hub tightly fitted and substantially fully mated within, and coextensive with, the outer flight body. The inner hub, cast formed of a more ductile, tougher homogeneous material, includes a hollow cylindrical interior surface structured for slidable engagement around and in driving connection with the drive shaft. The inner hub and outer flight body are securely engaged one to another by cast forming the outer flight body around the precast inner hub. Longitudinal lobes in a smooth undulating in and out clover leaf cross sectional pattern further increase rotational or torsional strength of the worm assembly without appreciably increasing internal operating stress between inner hub and outer flight body.

10 Claims, 4 Drawing Sheets

Fig. 5
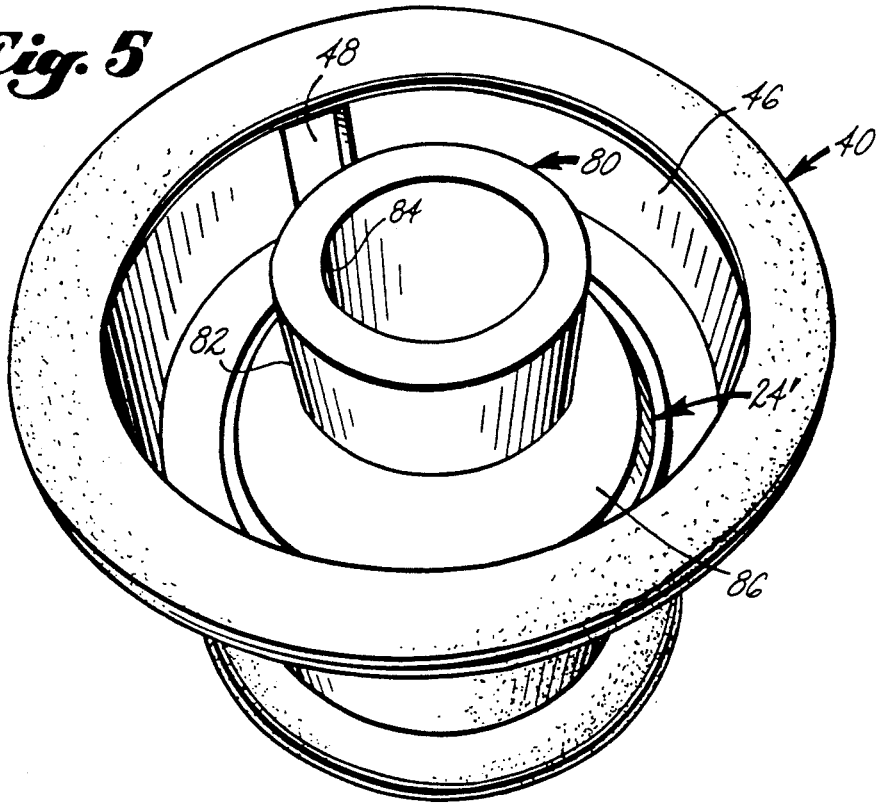
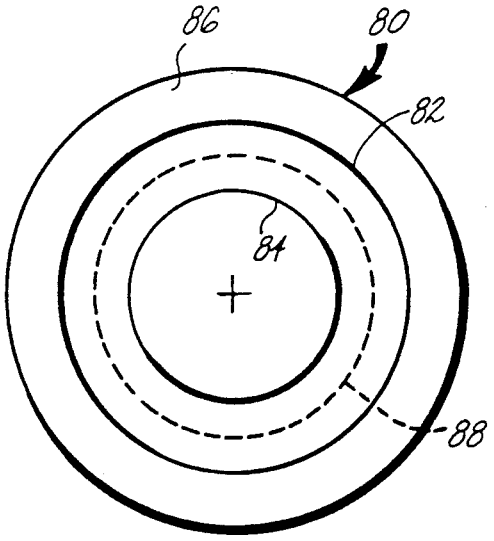
Fig. 7
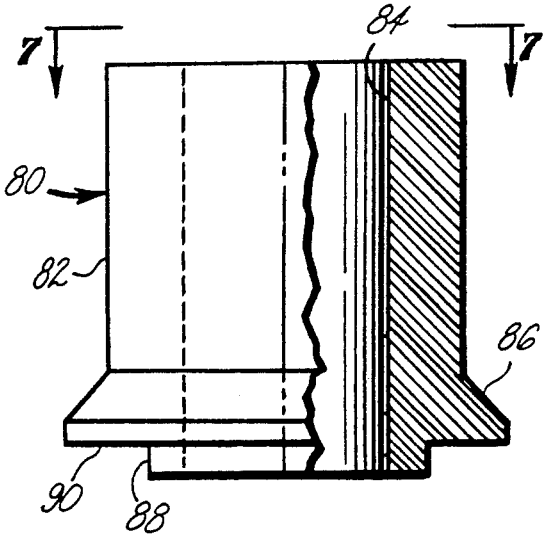
Fig. 6

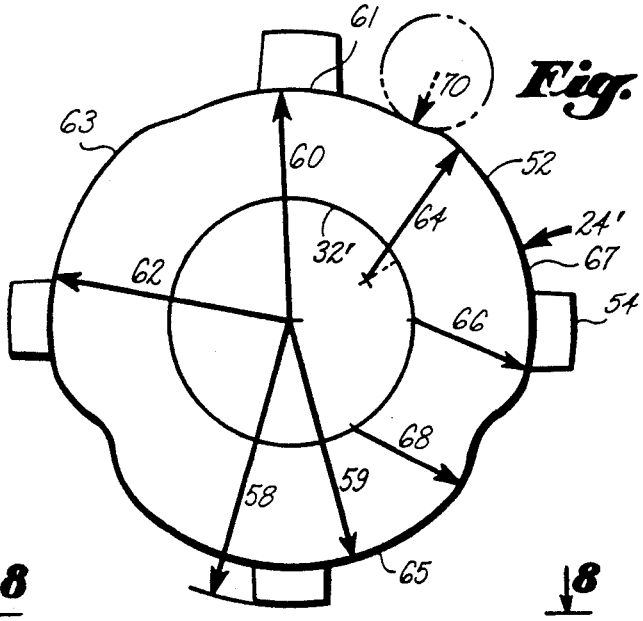
Fig. 8
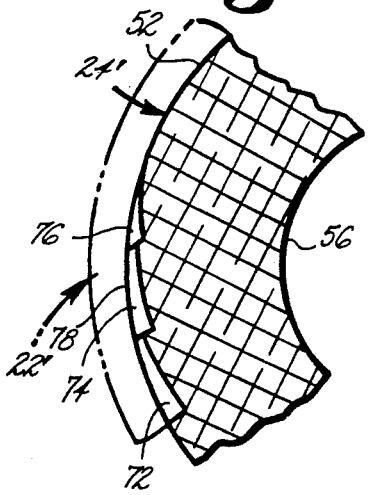
Fig. 10
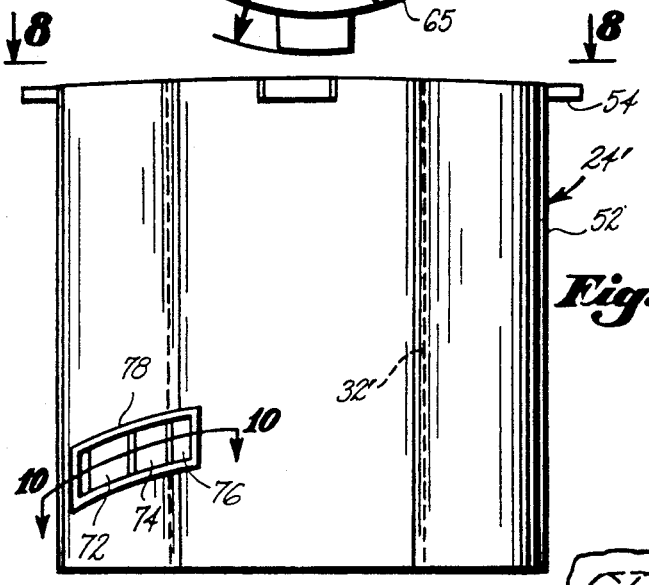
Fig. 9
Fig. 11
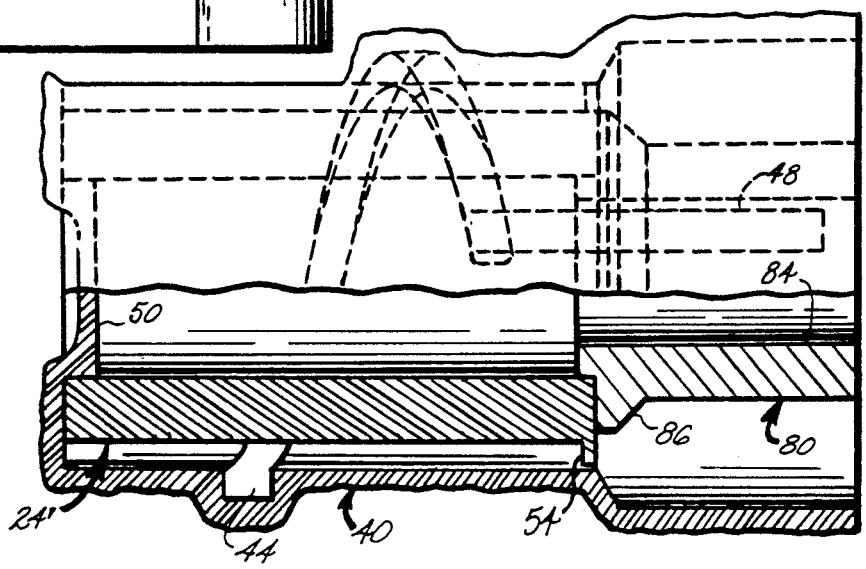

CAST FORMED BI-METALLIC WORM ASSEMBLY AND METHOD

BACKGROUND OF THE INVENTION

This invention relates generally to screw presses for expressing fluids from fibrous materials, and more particularly to a bi-metallic fully cast worm assembly for use in conjunction with such presses.

The flights on worm assemblies which radially extend from the flight body of feed screws of high pressure expressing presses incur substantial wear and abusive interaction with both fibrous material and debris contained therein as they interact with the walls of the screw press. It is a well-known technique to provide wear resistant or hard-facing coatings upon the surfaces of the flight and flight body which are subjected to highest wear. Techniques utilized for this purpose are deposit welding, flame spray deposition, plasma deposition and the like. Thereafter, the surfaces are smoothed manually back to the desired dimension of the flight. These conventional deposit welding techniques are labor intensive, require expensive components, and provide poor bonding between the ductile base material and the harder deposited weld material.

Considerable effort has been expended to resolve this wear problem as described in the following U.S. and foreign patents known to applicants which include some combination of bi-metallic structure incorporating a tough inner hub portion and a hard or brittle worm flight or portion thereof:

French U.S. Pat. No. 3,592,128
Bredeson U.S. Pat. No. 3,980,013
Knuth, et al. U.S. Pat. No. 4,223,601
Theysohn U.S. Pat. No. 4,364,664
Mansfield U.S. Pat. No. 4,440,076
Zies U.S. Pat. No. 3,034,424
French, et al. U.S. Pat. No. 3,721,184
Mansfield U.S. Pat. No. 4,838,700
Williamson U.S. Pat. No. 4,838,700
--- U.K. 592,834
--- Italy 557,425
Appleby U.K. 310,680

Several attempts have also been made to produce a homogeneous feed screw by utilizing casting techniques. However, if a highly wear resistant brittle material is chosen, cracking at the keyway or other highly stressed areas occurs. Alternately, where a more ductile material is used, premature wear of the flight is experienced.

Applicants have also invented another form of a bimetallic feed screw as described in U.S. Pat. No. 4,996,919. However, this invention is directed to the mechanical engagement of a precast flight within a mating cavity formed within the flight body itself.

The present invention utilizes the techniques of in situ cast forming of the outer worm flight of harder material around the pre-cast inner hub of relatively soft and tough material and a method of manufacture therefor. This structure is ideally suited for high wear resistance, minimum internal stress risers and maximized inner hub toughness and ductility, while also being recyclable.

BRIEF SUMMARY OF THE INVENTION

This invention is directed to a cast-formed bi-metallic worm assembly of a mechanical screw press for expressing liquids from fibrous materials, a method of manufacture therefor and the product produced by the method.

The worm assembly is rotatably driven by the press drive shaft and includes an outer flight body having an integral outwardly extending helical flight formed of a relatively brittle, wear-resistant homogeneous cast material and an inner hub tightly fitted and substantially fully mated within, and coextensive with, the outer flight body. The inner hub, cast formed of a more ductile, tougher homogeneous material, includes a hollow cylindrical interior surface structured for slidable engagement around and in driving connection with the drive shaft. The inner hub and outer flight body are securely engaged one to another by cast forming the outer flight body around the precast inner hub. Longitudinal lobes in a smooth undulating in and out clover leaf cross sectional pattern further increase rotational or torsional strength of the worm assembly without appreciably increasing internal operating stress between inner hub and outer flight body.

It is therefore an object of this invention to provide a bi-metallic worm assembly for screw presses which is fabricated having an inner hub using conventional casting techniques and a flight body formed of harder, wear-resistant material, the inner hub formed of more ductile, softer and tougher material.

It is another object of this invention to provide a bi-metallic worm assembly for screw presses which is primarily reliant upon the metallurgical bonding between inner hub and outer flight body for torsional strength and rigidity which results from casting the outer flight body around the precast inner hub.

It is yet another object of this invention to provide a method of manufacturing a highly wear-resistant bimetallic worm assembly for screw presses.

It is yet another object of this invention to provide a reusable bi-metallic worm assembly wherein the outer flight body may be separated from the inner hub for remelting of the harder flight body material, and recycling of the inner hub, which is typically not in need of repair or replacement and may be reused or both metals returned for remelt.

It is yet another object of this invention to provide the above bimetallic worm assembly produced by the above method of manufacture.

In accordance with these and other objects which will become apparent hereinafter, the instant invention will now be described with reference to the accompanying drawings.

BRIEF DESCRIPTION OF THE DRAWINGS

FIG. 5 is a view similar to FIG. 4 further showing a cast ceramic pouring ring in place prior to casting.

FIG. 6 is a side elevation partially broken view of the ceramic pouring ring shown added in FIG. 5.

FIG. 7 is a top plan view in the direction of arrows 7—7 in FIG. 6.

FIG. 8 is a top plan view of the precast inner hub as shown in the direction of arrows 8—8 in FIG. 9.

FIG. 9 is a side elevation view of FIG. 8.

FIG. 10 is a section view in the direction of arrows 10—10 in FIG. 9.

FIG. 11 is a side elevation partially broken section view of the entire molding assembly prior to casting.

DETAILED DESCRIPTION OF THE INVENTION

Figure 1:
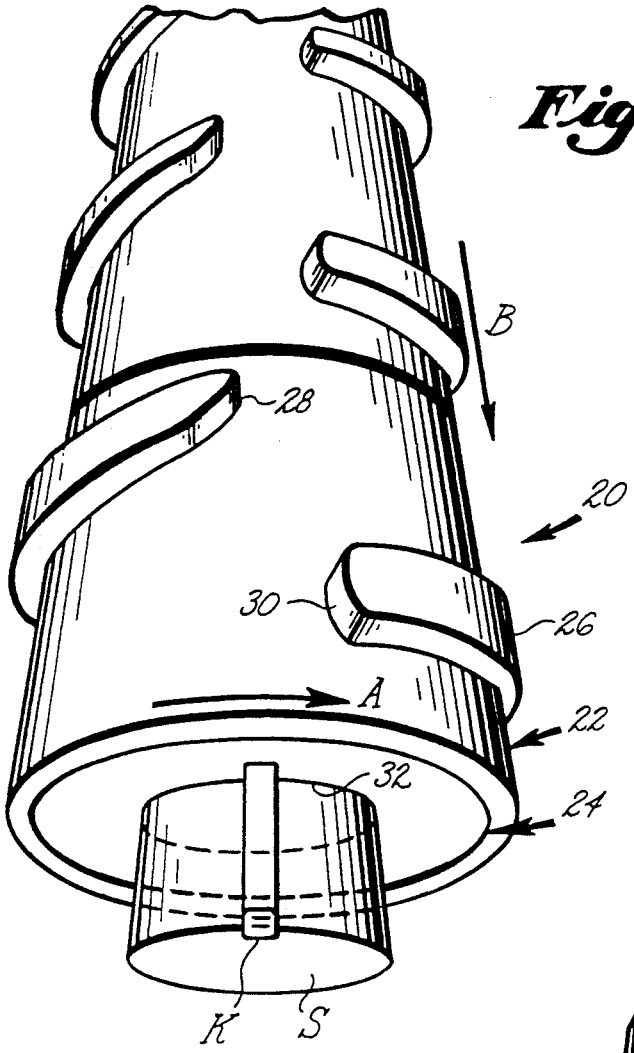
FIG. 1 is a perspective view of the invention in place on the press drive shaft.

Referring now to the drawings, and particularly to FIG. 1, the invention as a completed article of manufacture is shown generally at numeral 20 in its in-use configuration slidably mounted along side another over a drive shaft S in driving engagement therewith by keyway K. The entire arrangement rotates in the direction of arrow A about the longitudinal axis of drive shaft S and by this arrangement, material to be expressed moves within the screw press in the direction of arrow B.

Each of the worm assemblies 20 includes an inner hub shown generally at numeral 24 and an outer flight body shown generally at numeral 22. The inner hub 24 includes an axial cylindrical drive shaft hole longitudinally therethrough 32 which slidably engages over drive shaft S and keyway K. The outer flight body 22 includes a worm flight 26 which radially extends from the cylindrical main portion thereof. The leading end 28 of worm flight 26 is pointed so as to more easily pierce or penetrate through the fibrous material, while the trailing end 30 is blunt so as to further reduce the likelihood of fracturing of the worm flight 26.

The inner hub 24 is cast formed of a tougher, more ductile cast steel material such as 1015–1020 steel or series 300 stainless steel. The outer flight body 22 is cast formed in place around the precast inner hub 24 of a harder, more brittle cast material, preferably a cast nickel base metal which includes chrome, boron and steel. The tougher more ductile inner hub 24 thus absorbs the driving forces from drive shaft S and key way K, while the harder material of the outer flight body 22 is more wear resistant to the liquid expressing process and wherein the flights 26 are likely to forcibly encounter foreign objects such as rocks, stones and other debris.

Figure 2:
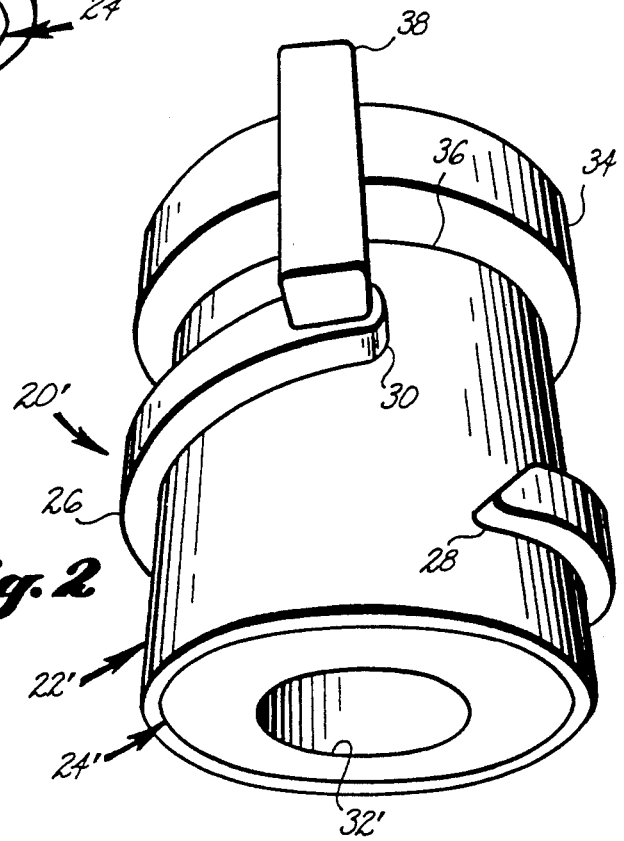
FIG. 2 is a perspective view of the invention immediately following completion of casting and including the casting risers.

Referring additionally to FIG. 2, the invention in its as-cast, unmachined form is there shown generally at numeral 20'. In general, all primed (') numerals refer to unmachined as-cast components. This worm assembly casting 20' initially includes risers 38 and 34 which are added for improved casting soundness of the outer worm assembly 22' cast formed in place around the precast inner hub 24'. After removal of risers 38 and 34 by conventional abrasive sawing along 36 and between riser 38 and worm flight 26, the inner bore 32' is then machined, along with trueing of the end surfaces perpendicular to the axis of inner bore 32, when machine finished.

Figure 3:
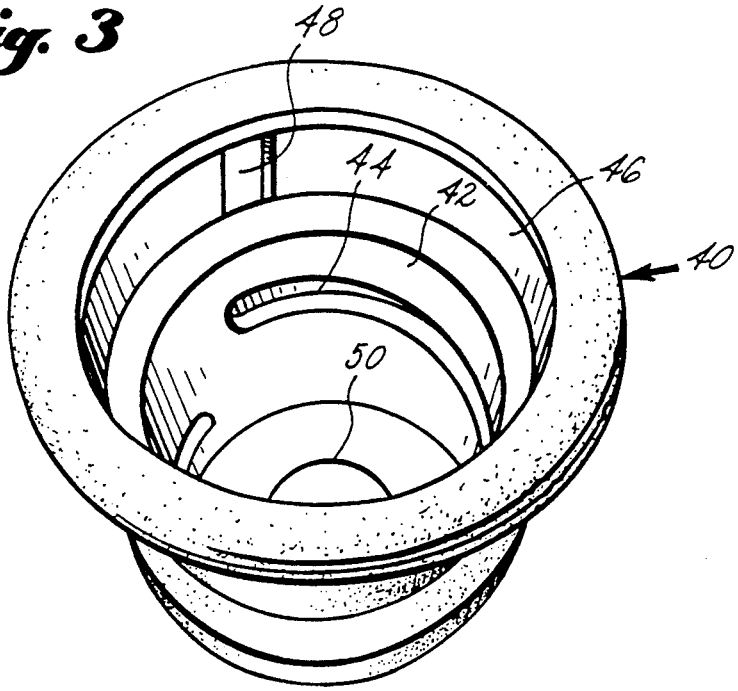
FIG. 3 is a perspective view looking down into a mold utilized in producing the casting shown in FIG. 2.

The ceramic mold utilized to cast form the present invention is shown in FIG. 3 at numeral 40. This mold 40 is precast of ceramic material using a lost-wax type process or its equivalent for improved casting detail and accuracy. The mold 40 provides a cylindrical outer surface 42 for forming the outer worm assembly, a worm flight cavity 44 and riser cavities 46 and 48. Also provided with mold 40 is raised centering boss 50 utilized for alignment of the inner hub casting as will be described herebelow.

Figure 4:
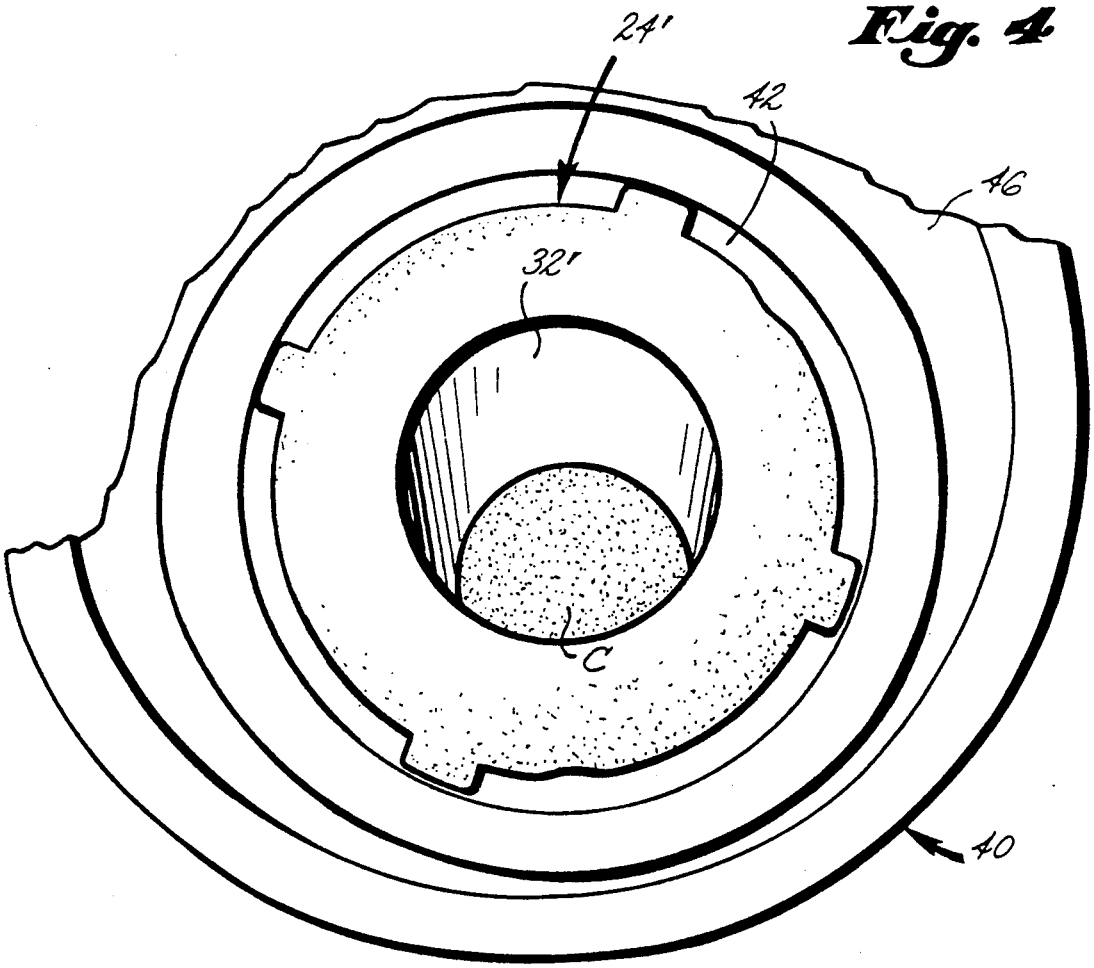
FIG. 4 is an enlarged partial view similar to FIG. 3 showing the precast inner hub in place within the mold prior to casting.

Referring next to FIG. 4, the precast unmachined inner hub 24' is positioned into mold 40 as shown so that the upper end is generally flush with the beginning of riser cavity 46. Referring additionally to FIGS. 8, 9 and 11, the precast inner hub 24' includes a generally cylindrical outer profile 52 extending coaxially with longitudinal drive shaft hole 32'. This outer profile 52 is generally configured to provide smooth in and out undulations, rather than a circular cross section so as to offer increased mechanical driving engagement with the outer worm body. The preferred embodiment of these smooth in and out undulations is best seen in FIG. 8 and includes a plurality of lobes 61, 63, 65, and 67 each defined by a radial surface about a central axis of inner hub 24' equal to 59, 60, and 62 as indicated. Each lobe is further defined at the end of the major radii 59, 60, and 62 by smaller convex blend radii 64, 66, and 68 as shown having; a concaved junction at blend radius 70 as highlighted in a phantom circle.

The cast inner hub 24' also includes radially extending centering tabs 54 having an outer radial profile 58. These tabs 54 serve to center the cast inner hub 24' within mold 40 as best seen in FIGS. 4 and 11 and are preferably trued to have profile 58 in FIG. 8 concentric.

After the inner hub casting 24' is placed within mold 40 as shown in FIG. 4 with the drive shaft hole 32' centered on raised boss 50 seen in FIG. 3, a small quantity of sand C is then placed within the drive shaft hole 32'. The sand C is utilized to help provide a bottom seal, preventing molten material from entering into that region during the final casting process of the outer worm body 22'.

Referring additionally and particularly to FIGS. 5 to 7 and FIG. 11, a ceramic pouring ring 80 is then placed in axial alignment within mold 40 and atop inner hub casting 24'. This pouring ring 80 includes a cylindrical main body 82 with longitudinal aperture 84 therethrough. An integral radially extending flange 86 forms transverse stop 90 which rests atop the upper end of inner hub casting 24'. Cylindrical outer surface 88 aligns the pouring ring 80 within the upper end of drive shaft hole 32'. When in place as shown in FIGS. 5 and 11, the pouring ring 80 prevents molten metal which will form the outer worm body 22' from entering the drive shaft hole 32' and also serves to form the inner contour of riser 34, the outer surface of riser 34 defined by riser cavity 46.

The arrangement shown in FIG. 5 is now ready to receive the cast molten outer worm body material poured into mold 40 and around pouring ring 80. A weight must be placed atop pouring ring 80 so as to help prevent "floating" of the pouring ring 80 as the riser cavity 46 is filled near the end of each pour. This weight can also be designed to provide three point centering of the inner cast hub, pouring ring and the ceramic mold.

To further assist in sealing the interior of drive shaft hole 32' from the hot molten casting material forming the outer worm body 22', a "fiber fax" gasket may also be placed between the top of inner hub 24' and surface 90 of pouring ring 80.

Referring now to FIGS. 9 and 10, a flight lock arrangement is there shown including a flight lock cavity 78 cast formed into the outer surface 52 of inner hub 24' lying directly under the leading edge of the flight. This flight lock cavity 78 includes a plurality of wedge-shaped connected cavity segments 72, 74 and 76 which, when filled with molten cast metal forming the outer worm body 22 in phantom in FIG. 10, serve to provide an additional rotational mechanical engagement between the inner hub 24' and the outer flight body 22'.

COMPOSITION OF OUTER WORM BODY

Generally, the outer worm body 22' is cast formed utilizing the method as previously described of a homogenous material considerably harder and more brittle than that utilized to cast form the inner hub 24'. Typical materials which may serve this purpose are cobalt based materials and nickel based materials. However, the preferred embodiment of this worm body cast material is a nickel-chrome-boron composition. Such an alloy is generally available from Stoody-Deloro Stellite Corporation under their designation "Alloy 45", or can be custom formulated during melting. This composition is selected because of its higher hardness (Rockwell C 50–55) and because it has a solidifying temperature of approximately 1900 degrees F., or considerably below the approximate melting temperature selected for the inner hub cast material of approximately 2600 degrees F.

This temperature solidifying differential between the outer worm assembly 22' and the inner hub casting 24' facilitates an easy procedure for reclaiming of the expensive nickel-chrome-boron and the inner hub casting when normal wear of the worm flights 26 occurs. By heating the used worm assembly 20 to approximately 2000 degrees F., the outer worm assembly cast material is liquified, leaving the inner hub casting intact.

More specifically with respect to the metallurgical composition of the outer worm body casting 22', the preferred range of elements are listed in Table 1 herebelow:

TABLE 1

| Element | Percentage |
|---|---|
| Silicon | 3.0–5.0% |
| Carbon | 0.3–0.6% |
| Chromium | 7.5–14.5% |
| Boron | 1.1–3.7% |
| Iron | 3.0 (max) |
| Nickel | 73.2–85.1% |
| Rockwell C hardness: | 50–55 |

As will now be appreciated, the primary metallurgical elements utilized in the preferred embodiment are nickel, chromium and boron. Normally, the boron content, which is particularly important in varying the hardness, is about 0.5%. However, the present invention advances that percentage up to above 1.0% and up to above 3.7% helping to insure the hardness range indicated.

To inhibit oxidation of the outer surface of the inner hub casting 24', this casting is nickel plated prior to beginning the casting process. This oxidation would otherwise occur as inner hub casting 24' is preheated before the molten outer worm assembly material is cast around the inner hub casting 24' as previously described.

METHOD OF CASTING

After the various components are arranged and preheated to approximately 1800 degrees F. as shown and described with respect to FIG. 5, the molten cast outer worm body material at a temperature of approximately 2600 degrees F. is poured into mold 40. To retard the rate of cooling and solidification of this molten cast material, mold 40 is placed into and buried within a large volume of sand such as in a large barrel up to the upper flange of mold 40. This surrounding sand causes the molten metal to cool slowly and at the same time to anneal the inner hub 24'. Typically this cooling and solidification period is about 24 to 30 hours.

Thereafter, when the casting is fully solidified as shown in FIG. 2, the risers 34 and 38 are remove by abrasive cutters along line 36, the inner bore 32' is finished and keyway added, and the opposite ends are then machined perpendicular to the finished drive shaft bore 32.

PRODUCT BY PROCESS IDENTIFICATION

Because of the unique casting methodology as above described, the finished worm flight body 20 may be clearly identified from any other product having a similar bimetallic structure formed by another method such as by braising, mechanical shrinkage, plasma spray deposit or the like. By microanalysis of the grain structure at the boundary between the precast inner hub 24' and the in situ cast formed outer worm body 22', it is clear that the grain structure of each component is fully distinguishable because the cast structure of each shows a typically dendritic structure of an as-cast material. A weld overlay bimetallic product on the other hand will show an intermixed structure of dendritic (cast) and equaxed (reheated) grains resulting from different heating and cooling rates than that of the worm flight body produced by the method of this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A cast formed bi-metallic worm assembly in a mechanical screw press having a rotary drive shaft in driving engagement with said worm assembly comprising:

a precast inner hub having a uniform cylindrical outer surface and a hollow interior surface structured for slidable engagement around and in driving communication with the drive shaft, said inner hub formed of a first rigid homogeneous cast material;

an outer flight body cast formed in place around and over substantially the entire length of, said inner hub outer surface, said flight body also having an integrally cast helical flight extending radially therefrom, said outer flight body formed of a second homogeneous cast material;

said second cast material harder than said first cast material;

said flight body in rotational driving engagement with said inner hub outer surface held thusly only by metallurgically bonding which results from cast forming said outer flight body around said precast inner hub.

2. A cast formed bi-metallic worm assembly as set forth in claim 1, wherein:

said inner hub outer cylindrical surface includes at least one uniform longitudinal lobe having a smooth, uniform cross sectional shape undulating radially in and out along the entire length of said worm assembly for increased rotational driving engagement between said inner hub and said flight body.

3. A cast formed bi-metallic worm assembly as set forth in claim 2, further comprising:

a flight lock cavity formed into said inner hub outer surface and including at least one wedge-shaped cavity portion which, when filled with said second cast material in cast forming said outer flight body, provides additional rotational mechanical engagement between said inner hub and said outer flight body.

4. A cast formed bi-metallic worm assembly as set forth in claim 3, wherein:

said flight includes a generally pointed leading end and a generally rounded trailing end.

5. A cast formed bi-metallic worm assembly as set forth in claim 1, wherein:

said outer flight body consists essentially of silicon, carbon, chromium, boron, iron and nickel.

6. A cast formed bi-metallic worm assembly as set forth in claim 5, wherein:

silicon is present in said outer flight body in the range of about 3.0 to 5.0 percent by weight;

carbon is present in said outer flight body in the range of about 0.3 to 0.6 percent by weight;

chromium is present in said outer flight body in the range of about 7.5 to 14.5 percent by weight;

boron is present in said outer flight body in the range of about 1.1 to 3.7 percent by weight;

iron is present in said outer flight body in the range of about a maximum of 3.0 percent by weight;

nickel is present in said outer flight body in the range of about 73 to 85 percent by weight.

7. A method of manufacturing a bi-metallic worm assembly of a mechanical screw press, said worm assembly including a hollow cylindrical inner hub having a generally cylindrical outer surface and an interior surface structured to slidably engage around and in driving communication with a drive shaft, said inner hub formed of a first rigid homogeneous cast material, said worm assembly also including an outer flight body formed of a second rigid homogeneous cast material circumferencially encapsulating said inner hub outer surface and also having an integral helical flight radially extending therefrom, said second cast material harder than said first cast material, said first cast material having a plastic temperature substantially higher than said second cast material, said method comprising the steps of:

a) east forming said inner hub;

b) placing said inner hub into a mold having an interior defining said outer flight body;

c) preheating said inner hub within said mold;

d) east forming said outer flight and body around said inner hub within said mold;

e) slowly cooling said worm assembly to room temperature, said inner hub and said outer flight body metallurgically bonding one to another.

8. A method of manufacturing a bi-metallic worm assembly of a mechanical screw press as set forth in claim 7, further comprising plating said inner hub prior to step B.

9. A bi-metallic worm assembly of a mechanical screw press, said worm assembly including a hollow cylindrical inner hub having a generally cylindrical outer surface and an interior surface structured to slidably engage around and in driving communication with a drive shaft, said inner hub formed of a first rigid homogeneous cast material, said worm assembly also including an outer flight body formed of a second rigid homogeneous cast material circumferencially encapsulating said inner hub outer surface and also having an integral helical flight radially extending therefrom, said second cast material harder than said first cast material, said first cast material having a plastic temperature substantially higher than said second cast material, said worm assembly produced by the steps of:

a) east forming said inner hub;

b) placing said inner hub into a mold having an interior defining said outer flight body;

c) cast forming said outer flight body around said inner hub within said mold;

d) slowly cooling said worm assembly to room temperature, said inner hub and said outer flight body metallurgically bonding one to another.

10. A bi-metallic worm assembly of a mechanical screw press as set forth in claim 9, wherein said steps for producing said worm assembly further comprise:

plating said inner hub prior to step B.

* * * * *

UNITED STATES PATENT AND TRADEMARK OFFICE

CERTIFICATE OF CORRECTION

PATENT NO. : 5,188,023

DATED : February 23, 1993

INVENTOR(S) : Mansfield, et al.

It is certified that error appears in the above-identified patent and that said Letters Patent is hereby corrected as shown below:

Column 8, line 3, replace "east" with -- cast --.

Column 8, line 7, replace "east" with -- cast --.

Column 8, line 31, replace "east" with -- cast --.

Signed and Sealed this

Sixteenth Day of November, 1993

*Attest:*

Bruce Lehman

BRUCE LEHMAN

*Attesting Officer*

*Commissioner of Patents and Trademarks*